US006081244A

United States Patent [19]

Peck

[11] Patent Number: 6,081,244

[45] Date of Patent: Jun. 27, 2000

[54] METHOD AND APPARATUS FOR AN UNFURLABLE ISOMETRIC ANTENNA REFLECTOR

[75] Inventor: Scott Owen Peck, Palo Alto, Calif.

[73] Assignee: Space Systems/Loral, Inc., Palo Alto, Calif.

[21] Appl. No.: 09/210,967

[22] Filed: Dec. 14, 1998

[51] Int. Cl.[7] ..... H01Q 15/20

[52] U.S. Cl. ..... 343/915; 343/912; 343/DIG. 2

[58] Field of Search ..... 343/915, 914, 343/912, 913, 916, DIG. 2; H01Q 15/20

[56] References Cited

U.S. PATENT DOCUMENTS

| | | | |
|---|---|---|---|
| 5,451,975 | 9/1995 | Miller et al. | 343/915 |
| 5,635,946 | 6/1997 | Francis | 343/915 |
| 5,990,851 | 6/1997 | Henderson et al. | 343/915 |

*Primary Examiner*—Hoanganh Le
*Attorney, Agent, or Firm*—Perman and Green, LLP

[57] ABSTRACT

An antenna reflector comprising a single membrane antenna reflector surface and means for supporting said antenna reflector surface are disclosed wherein a shape of said antenna reflector is reconfigured to assume a stowed position. The shape of the stowed reflector allowing a large, single piece antenna reflector to be stowed efficiently inside a minimum payload area of the space vehicle. The method and apparatus of this invention ensure that both the deployed and stowed surfaces of the membrane antenna reflector are isometric, or length preserving, mappings of one another. The circumferential dimension of the antenna reflector is decreased having the effect of rolling up the paraboloid so that its surface is similar to a cone. Additionally, the method and apparatus are employed such that when the antenna reflector surface is deployed the antenna reflector membrane unrolls without stretching.

11 Claims, 3 Drawing Sheets

METHOD AND APPARATUS FOR AN UNFURLABLE ISOMETRIC ANTENNA REFLECTOR

FIELD OF THE INVENTION

The invention generally relates to deployable satellite reflectors of the type launched and sustained in space, typically about Earth's orbit or for deep space probe applications. Specifically, the invention relates to a stowage method and apparatus for an unfurlable isometric antenna reflector.

BACKGROUND OF THE INVENTION

High-gain antenna reflectors have been deployed in space for several decades. The configurations of such reflectors have varied widely as material science developed and as the sophistication of technology and scientific needs increased. However, some constants within the technology of antenna reflectors have emerged. First, an ideal contour for a deployed reflective surface of the antenna reflector is one which results in a parabolic configuration. Second, power and performance of an antenna system is directly related to the size of the deployed reflective surface. Thus, the optimum antenna reflector is one which, on deployment, assumes an, ideally, parabolic configuration and which possesses the largest practical reflective surface area.

Large diameter antenna reflectors pose particular problems during deployment. Likewise, large, completely rigid antennas are highly impractical to launch into space in a deployed position. Thus, large antennas are typically stored in a collapsed position within a payload space of a space vehicle prior to deployment. To maximize payload space within the space vehicle for other purposes, it is beneficial to minimize the storage space consumed by the collapsed antenna. In an attempt to minimize their required storage space, antennas are typically of a collapsible and/or a foldable construction.

At present, antenna reflectors of the collapsible or the foldable variety are of three design types. One design is a grid, or mesh type, antenna reflector that is closed like an umbrella. In its stowed position, the mesh antenna reflector achieves a reduced circumferential dimension. However, the reduction of the circumferential dimension results in a larger radial storage dimension. The radial storage dimension is typically reduced by folding the reflector.

In a second design, a solid surface antenna reflector and its supporting structure are folded against a side of a spacecraft prior to launch. For example, the solid surface antenna reflector may be attached to the spacecraft by means of a hinge. In this configuration, the antenna reflector is pivoted about the hinge to a closed position along side the spacecraft prior to launch. After launch, the reflector is deployed by pivoting the reflector to an open position away from the spacecraft.

Alternatively, an antenna reflector may include a reflector surface that comprises segmented petals, for example, commonly assigned U.S. Pat. No. 5,451,975, issued Sep. 19, 1995, entitled "Furlable Solid Surface Reflector", by Miller et al. Miller et al. teach a furlable solid surface reflector having several long, tapered petals which form a solid, continuously curved parabolic surface when in a deployed position, and which form a conical shape when in an undeployed, stored position.

In conventional segmented petal antenna reflectors, the segmented petals may be stored in various overlapped configurations. In a stowed position, the segmented petal antenna reflectors are collapsed to achieve a reduced circumferential dimension. However, as a reflector's surface area becomes large an increased number of joints and segments are required to collapse the reflector surface into manageable sized petals. Even with storage techniques that overlap the petals, the number of petals required to collapse an antenna reflector with a large surface area consumes significant storage space. Additionally, the larger the number of petals that comprise an antenna reflector the more complex the deployment mechanism becomes in order to reassemble the antenna reflector. A complex deployment mechanism may result in additional structural components which may increase the storage requirement of the collapsed antenna reflector within the payload of the space vehicle.

Thus, there remains a need for a storage method and apparatus that maximizes the deployed antenna reflector's surface area, minimizes the collapsed stowage requirement, and enables the deployed antenna reflector to assume a desired parabolic configuration.

OBJECTS AND ADVANTAGES OF THE INVENTION

It is a first object and advantage of this invention to provide a method and apparatus for stowing an antenna reflector inside a payload area of a space vehicle that overcomes the foregoing and other problems.

It is another object and advantage of this invention is to provide a method and apparatus for stowing a large, single piece antenna reflector efficiently inside a minimum payload area of the space vehicle.

It is a further object and advantage of this invention is to provide a method and apparatus for stowage that enables isometric mapping of a single piece membrane reflector surface, the mapping to preserve the radial length of the reflector and allow deployment without stretching the membrane reflector surface.

Further objects and advantages of this invention will become more apparent from a consideration of the drawings and ensuing description.

SUMMARY OF THE INVENTION

The foregoing and other problems are overcome and the objects of the invention are realized by a method and apparatus for an unfurlable isometric antenna reflector in accordance with the embodiments of this invention. More particularly, the invention provides a method and apparatus where a single piece membrane antenna reflector surface is rolled up such that a larger antenna is stowed inside a smaller storage area of a space vehicle than would otherwise be possible.

The method and apparatus of the present invention ensure that both the deployed and stowed surfaces of the membrane antenna reflector are isometric, or length preserving, mappings of one another. Thus, the circumferential dimension of the deployed antenna reflector is decreased having the effect of rolling up the paraboloid so that its surface is similar to a cone. Additionally, the method and apparatus are employed such that the circumferential dimension could be increased on deployment so that the antenna reflector surface unrolls without stretching the membrane antenna reflector surface. As a result, the diameter of the antenna reflector surface is reduced, while a length along a radius is maintained.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 1:
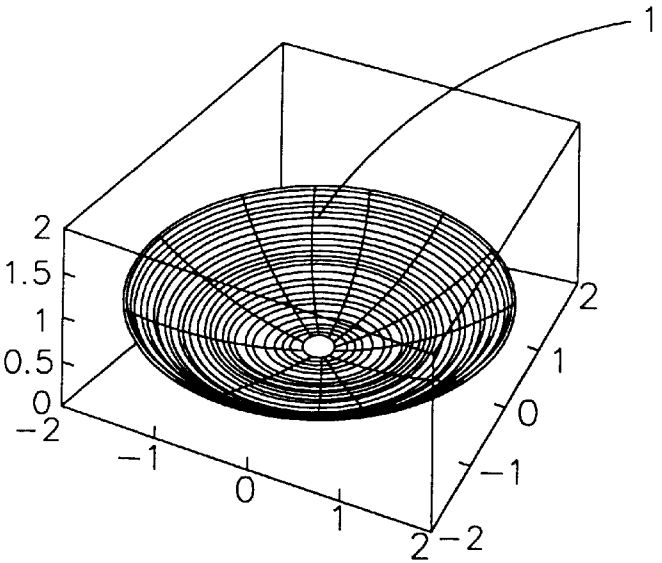
FIG. 1 is a view of a deployed, parabolic membrane antenna reflector (focal length, f=1)
Figure 3:
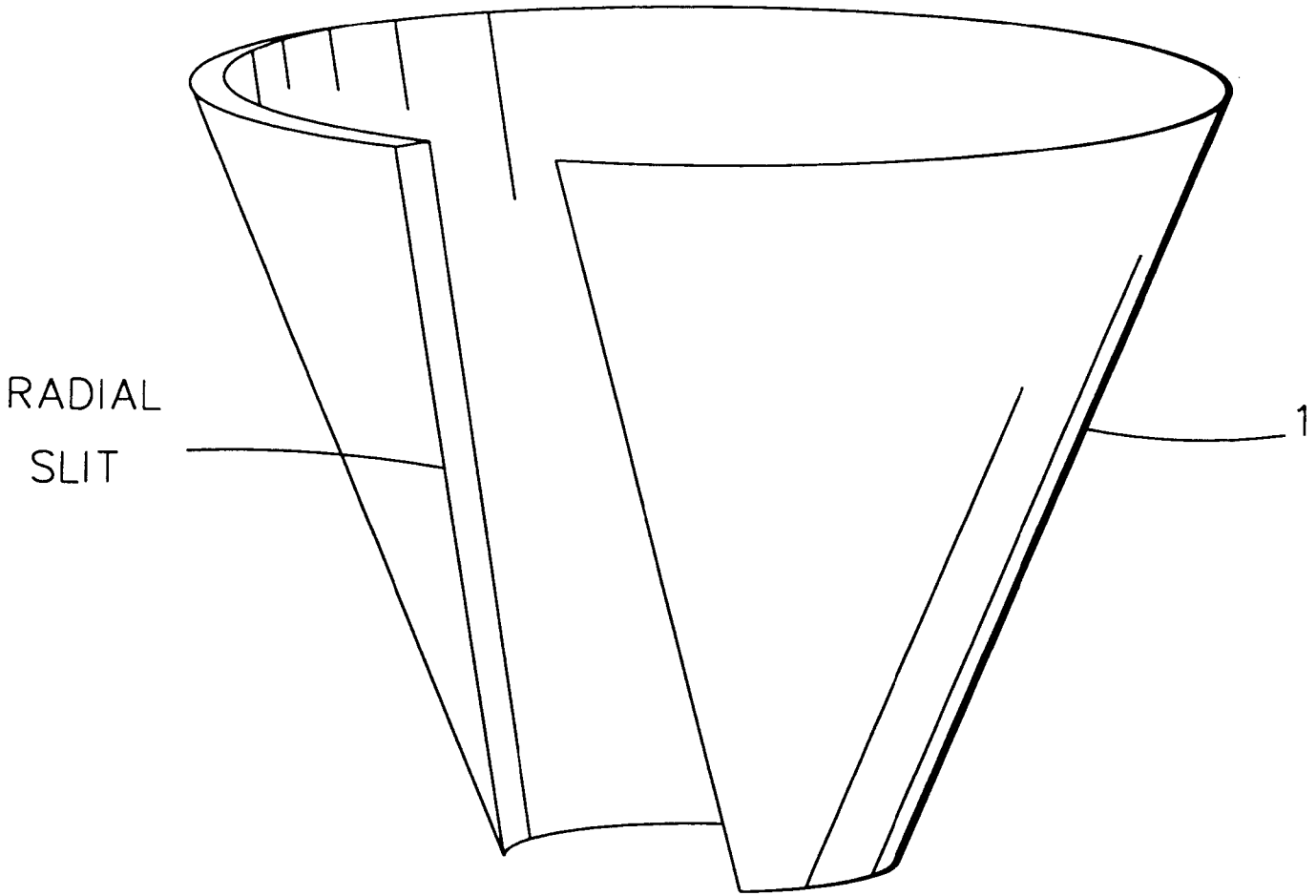
FIG. 3 is a view of a deployed, parabolic membrane antenna having a radial slit to facilitate stowage.
Figure 5:
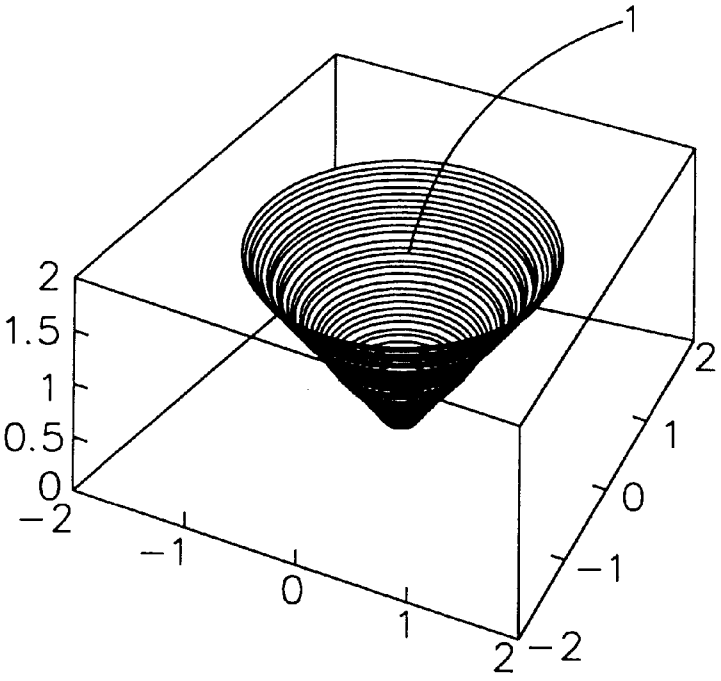
FIG. 5 is a view of a half stowed parabolic membrane antenna reflector (focal length, f=1; circumferential factor, a=1.5).

In accordance with the invention, and referring to FIG. 1, a single membrane antenna reflector 1 is shown at deployment, in its desired parabolic contour. Not shown in FIG. 1 is means for supporting the membrane antenna reflector 1 in its deployed and stowed positions. The means for supporting the membrane reflector may include any conventional antenna reflector supporting apparatus which is flexible enough to support the reflector as it is rolled up for stowage and unrolled for deployment. For example, a plurality of supporting ribs may be employed. When the reflector is deployed, the supporting ribs are disposed about an exterior surface of the membrane antenna. However, when the reflector is stowed, the supporting ribs allow the reflector to be rolled up.

Figure 2:
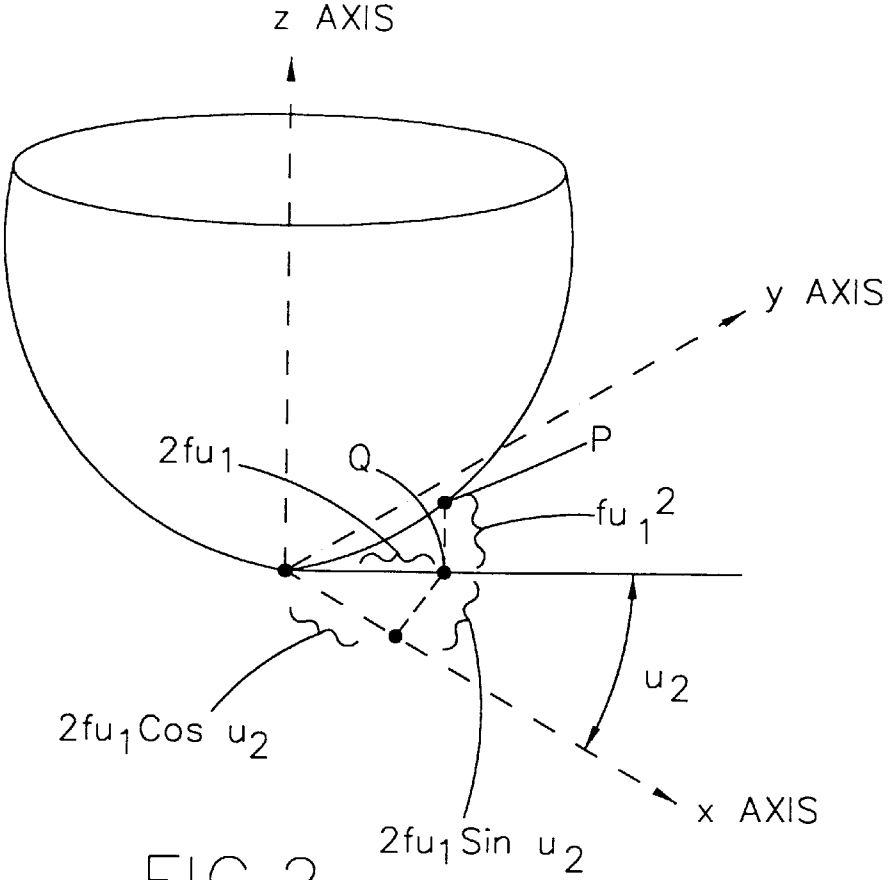
FIG. 2 depicts a paraboloidal surface and associated variables used to define a single membrane antenna reflector in its deployed position.

With reference to FIGS. 1 and 2, a non-parametric representation of the paraboloidal reflector membrane, assuming a focal length as defined by a variable "f", and Cartesian coordinates x, y, and z is shown in the following equation:

$$x^2+y^2=4fz \tag{1}$$

where x, y, z, and f all have dimensions of length.

A polar parametric representation of the paraboloidal reflector membrane is obtained by assigning x, y and z as follows:

$$x=2fu_1\ \mathrm{Cos}(u_2);\ y=2fu_1\ \mathrm{Sin}(u_2)\ \text{and}\ z=fu_1^2 \tag{2}$$

where:

$u_1$=the undirected distance from the pole, or origin, to any point, Q, in the x-y plane; and $u_2$=the radian measure between the x-axis and the line from the pole to the point Q.

FIG. 2 shows variables $u_1$ and $u_2$ in relation to a paraboloidal surface. The paraboloidal surface and associated variables are illustrative of the single membrane antenna reflector in its deployed position. As shown in FIG. 2, a point P of the paraboloid has Cartesian coordinates {x, y, Z} which satisfies Equations 1 and 2.

Thus, the polar parametric representation of the paraboloidal reflector membrane (e.g., point P on the paraboloidal surface) is given as a list of three Cartesian coordinates as shown in the following equation:

$$\mathrm{para1}[f][u_1, u_2]=\{2fu_1\ \mathrm{Cos}[u_2],\ 2fu_1\ \mathrm{Sin}[u_2],\ fu_1^2\} \tag{3}$$

where $u_1$ is dimensionless and $u_2$ has units of radians.

Representative dimensions for the paraboloidal reflector membrane, and variables $u_1$ and $u_2$, are given by considering the following. Typical satellite antenna reflectors range from about 0.5 meters to 2–3 meters in opening diameter. The ratio of focal length to reflector diameter (f/D) is typically specified in order to illustrate the portions of the paraboloidal reflector surface utilized as an antenna reflector. Thus, a maximum value of $u_1$ is determined as follows:

$$\frac{f}{D}=\frac{f}{2x^{\max}}=\frac{f}{2(2fu_1^{\max})},\ \text{so}\ u_1^{\max}=\frac{1}{4\left(\frac{f}{D}\right)}. \tag{4}$$

Thus, for example, an antenna reflector with a 2 meter opening diameter and a focal length of 0.5 meters would have an f/D=0.25. In this example, the value of $u_1$ would range from 0 to 1 and the value of $u_2$ would range from 0 to 2 Pi radians.

In accordance with the present invention, the material for the membrane of the paraboloidal antenna reflector is capable of supporting bending loads. The membrane's material is preferably thin and flexible enough to enable the displacement into the stowed and the deployed configurations. A membrane with these structural characteristics may be referred to as a shell. Preferably, antenna reflectors in accordance with the present invention are made of graphite fibers in a polymer resin matrix, which provides the desired strength and flexibility.

In the present invention, a reflector membrane 1 represented by Equation (3) is rolled up, i.e. stowed, by radially mapping points from the paraboloid to a new, more conic surface. Also, the antenna reflector membrane is slit once radially to facilitate the rolling up operation. Pig. 3 illustrates a parabolic antenna reflector having a radial slit.

The polar parametric representation of a surface of revolution to be determined, f h[a][$u_1$], that maps points from the paraboloid to the new surface using a mapping factor, "a", is given in the following equation:

$$para2[f, a][u_1, u_2]=\left\{2f\frac{u_1}{a}\mathrm{Cos}[au_2],\ 2f\frac{u_1}{a}\mathrm{Sin}[au_2],\ fh[a][u_1]\right\}. \tag{5}$$

Figure 4:
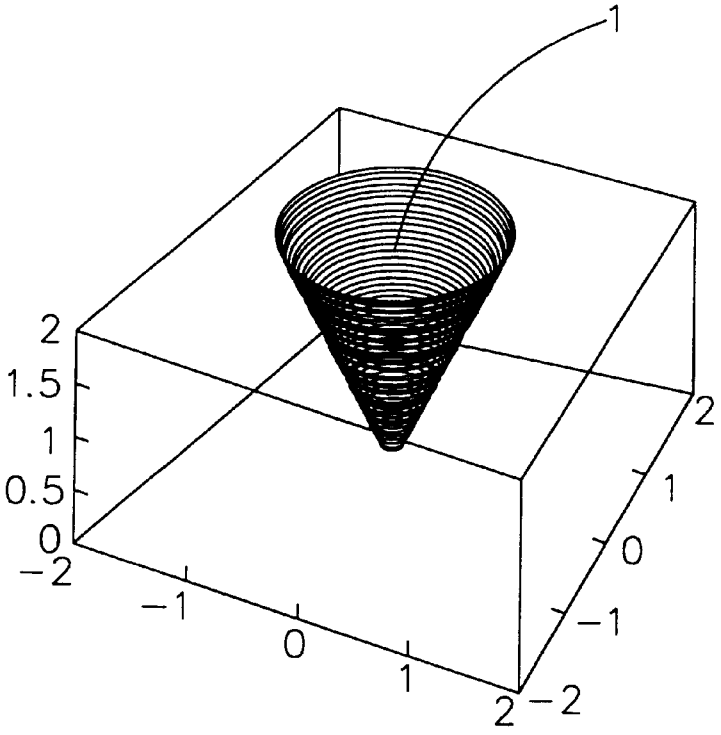
FIG. 4 is a view of a completely stowed parabolic membrane antenna reflector (focal length, f=1; circumferential factor, a=2). The membrane antenna reflector being completely wrapped around itself.

For example, if the mapping factor, "a", were assigned a value of two, then points are mapped around the circumferential direction by a factor of two while the radial mapping decreases by a factor of one half. FIG. 4 shows the reflector surface mapped by the mapping factor of two.

The mapping process in which the antenna reflector is rolled up, i.e. stowed, is demonstrated by comparing the paraboloidal reflector membrane as illustrated in FIG. 1, to the more conic reflector membrane as illustrated in FIG. 4. Thus, the mapping factor "a" represents the number of times the original surface is rolled up upon itself. As above, when "a" equals 2 the original surface of the reflector membrane is rolled, or rotated, through one complete revolution so that at every point two locations of the original membrane surface are in close proximity. Likewise, the radius at every point is reduced by a factor of 1/a, or in this example, by a factor of one half.

Two surfaces are shown to be isometric mappings of one another when their First Fundamental Forms, also known as their surface metrics, are equal. Thus, one surface is transformed into the other without changing the arc lengths, i.e. without stretching the surface. The First Fundamental Form of a paraboloid is given by the following equations:

$$E=4f^2(1+u_1^{32}) \tag{6}$$

$$F=0 \tag{7}$$

$$G=4f^2u_1^2. \tag{8}$$

The First Fundamental Form of the surface of revolution to be determined is given by the following equations:

$$E^* = \frac{4f^2}{a^2} + f^2\left(\frac{d\,h[a][u_1]}{d\,u_1}\right)^2 \tag{9}$$

$$F^* = 0 \tag{10}$$

$$G^* = 4f^2u_1^2. \tag{11}$$

In comparing the First Fundamental Forms of the paraboloid and of the surface of revolution outlined above reveals that in Equations (7) and (10), F and F* are equal, and in Equations (8) and (11), G and G* are equal. By equating the remaining forms in Equations (6) and (9), E arid E*, and solving for the function $h[a][u_1]$, the two surfaces are, by definition, isometric mappings of each other. Thus, the function $h[a][u_1]$ of Equation (5) is found to be:

$$h[a][u_1] = \frac{u_1}{a}\sqrt{a^2(1+u_1^2)-1} + \frac{(a^2-1)}{a^2}\log\left(2a^2u_1 + 2a\sqrt{a^2(1+u_1^2)-1}\right) - \frac{(a^2-1)}{a^2}\log\left(2a\sqrt{a^2-1}\right). \tag{12}$$

Note, the third term of Equation (12) is a constant that does not add to the description of the surface. Also, for values of the mapping factor, a=1, $h[a][u_1]=h[1][u_1]=u_1^2$, as expected. For values of "a" other than 1, the mapped surface is similar to a cone.

Therefore, a single membrane antenna reflector is stowed by increasing the value assigned to the mapping factor, "a", within Equations (5) and (12). Additionally, as demonstrated in Equation (12), the surfaces of the stowed, antenna reflector and deployed, parabolic antenna reflector are isometric mappings of each other. For example, FIG. 4 illustrates the single membrane antenna reflector in a half stowed position in which the mapping factor, "a", is equal to 1.5.

While the invention has been particularly shown and described with respect to preferred embodiments thereof, it will be understood by those skilled in the art that changes in form and details may be made therein without departing from the scope and spirit of the invention.

What is claimed is:

1. A satellite payload having an antenna reflector, comprising:

a single membrane antenna reflector surface; and means for supporting said antenna reflector surface;

wherein a deployed shape of said antenna reflector surface is reconfigured by isometrically mapping said deployed shape to a stowed shape of said antenna reflector surface such that said antenna reflector fits inside a minimum payload area of said satellite.

2. A satellite payload having an antenna reflector as in claim 1, wherein said membrane antenna reflector surface is isometrically mapped to preserve a radial length of said membrane antenna reflector surface and to allow deployment without stretching said membrane antenna reflector surface.

3. A satellite payload having an antenna reflector as in claim 1, wherein said deployed shape of said antenna reflector surface is reconfigured to said stowed shape of said antenna reflector surface by varying a mapping factor, "a", in accordance with the formula:

$$para2[f,a][u_1,u_2] = \left\{2f\frac{u_1}{a}\mathrm{Cos}[au_2],\ 2f\frac{u_1}{a}\mathrm{Sin}[au_2],\ fh[a][u_1]\right\}$$

wherein a variable $u_1$ is an undirected distance from a pole, or origin, to any point, Q, in the x-y plane, a variable $u_2$ is a radian measure between the x-axis and a line from said pole to said point. Q, and the function $h[a][u_1]$ is defined in accordance with the formula:

$$h[a][u_1] = \frac{u_1}{a}\sqrt{a^2(1+u_1^2)-1} + \frac{(a^2-1)}{a^2}\log\left(2a^2u_1 + 2a\sqrt{a^2(1+u_1^2)-1}\right) - \frac{(a^2-1)}{a^2}\log\left(2a\sqrt{a^2-1}\right).$$

4. A satellite payload having an antenna reflector as in claim 3, wherein said deployed shape of said antenna reflector surface is parabolic and said stowed shape of said antenna reflector surface is approximately conic.

5. A satellite payload having an antenna reflector as in claim 1, wherein said single membrane antenna reflector surface is slit once radially to facilitate storing.

6. A satellite payload having an antenna reflector as in claim 1, wherein said single membrane antenna reflector surface is thin, flexible, and capable of supporting bending loads.

7. A satellite payload having an antenna reflector as in claim 6, wherein said single membrane antenna reflector surface is constructed of graphic fibers in a polymer resin matrix.

8. A method of reconfiguring a deployed shape of an antenna reflector for storing the antenna reflector in a payload area of a satellite, the antenna reflector having a single membrane antenna reflector surface and means for supporting the antenna reflector surface, the method comprises the step of:

reconfiguring the deployed shape of the antenna reflector by isometrically mapping the single membrane antenna reflector surface from a deployed shape to a stowed shape such that the antenna reflector fits inside a minimum payload area of the satellite.

9. A method of reconfiguring a deployed shape of an antenna reflector for storing the antenna reflector in a payload area of a satellite as in claim 8, wherein in the step of reconfiguring the membrane antenna reflector surface the isometric mapping preserves a radial length of the membrane antenna reflector surface and allows deployment without stretching the membrane antenna reflector surface.

10. A method of reconfiguring a deployed shape of an antenna reflector for storing the antenna reflector in a payload area of a satellite as in claim 8, wherein the step of reconfiguring the deployed shape of the antenna reflector further comprises the step of:

mapping the single membrane antenna reflector surface by varying a mapping factor, "a", in accordance with formula:

$$para2[f, a][u_1, u_2] = \left\{2f\frac{u_1}{a}\mathrm{Cos}[au_2],\ 2f\frac{u_1}{a}\mathrm{Sin}[au_2],\ fh[a][u_1]\right\}$$

wherein a variable $u_1$ is an undirected distance from a pole, or origin, to any point, Q, in the x-y plane, a variable $u_2$ is a radian measure between the x-axis and a line from said pole to said point Q, and the function $h[a][u_1]$ is defined in accordance with the formula:

$$h[a][u_1] = \frac{u_1}{a}\sqrt{a^2(1+u_1^2)-1} + \frac{(a^2-1)}{a^2}\log\left(2a^2u_1 + 2a\sqrt{a^2(1+u_1^2)-1}\right) - \frac{(a^2-1)}{a^2}\log\left(2a\sqrt{a^2-1}\right).$$

11. A method of reconfiguring a deployed shape of an antenna reflector for storing the antenna reflector in a payload area of a satellite as in claim 10, wherein the mapping factor "a" represents a number of times the deployed shape of the antenna reflector surface is rolled up upon itself, and a radius at every point of the antenna reflector surface is reduced by 1/"a".

* * * * *